United States Patent [19]

Ostrowski

[11] 4,265,296

[45] May 5, 1981

[54] INVESTMENT CASTING MOLD FORMING APPARATUS

[75] Inventor: Richard C. Ostrowski, Dunlap, Ill.

[73] Assignee: Caterpillar Tractor Co., Peoria, Ill.

[21] Appl. No.: 4,112

[22] Filed: Dec. 21, 1978

[51] Int. Cl.[3] ..... B22C 13/08

[52] U.S. Cl. ..... 164/165; 118/304; 118/309; 118/312; 118/DIG. 5; 164/26

[58] Field of Search ..... 164/165, 166, 26, 5, 164/192; 118/308, 309, 312, 304, 429, DIG. 5; 425/DIG. 20

[56] References Cited

U.S. PATENT DOCUMENTS

| | | | |
|---|---|---|---|
| 2,932,864 | 4/1960 | Mellen, Jr. et al. | 164/26 |
| 3,530,826 | 9/1970 | Trench | 118/310 |
| 3,713,475 | 1/1973 | Roelofs et al. | 164/26 |
| 3,788,380 | 1/1974 | Jasson et al. | 164/26 |
| 4,146,466 | 3/1979 | Chapman | 427/185 X |

FOREIGN PATENT DOCUMENTS

| | | | |
|---|---|---|---|
| 1155883 | 10/1963 | Fed. Rep. of Germany | 164/165 |
| 1292836 | 4/1969 | Fed. Rep. of Germany | 118/DIG. 5 |

*Primary Examiner*—Robert D. Baldwin
*Assistant Examiner*—J. Reed Batten, Jr.
*Attorney, Agent, or Firm*—Wegner, Stellman, McCord, Wiles & Wood

[57] ABSTRACT

Investment casting mold forming apparatus including a vertically extending housing (10) having a top (22), a bottom (28) and an access opening (20) intermediate the top and the bottom, a diffuser (26) within the housing below the opening and above the bottom, a pressure fluid inlet (32) in the housing between the bottom and the diffuser for providing fluid so that a fluidized bed and particulate material may be generated above the diffuser, and a distributor (50,52,60) introducing particulate material into the housing at its top and above a fluidized bed therein such that the particulate material so introduced may descend, by gravity, within the housing towards the fluidized bed.

6 Claims, 4 Drawing Figures

52
80
78
82
72
74
76
56
70
54
68
66

52
60
62
60
62

INVESTMENT CASTING MOLD FORMING APPARATUS

DESCRIPTION

TECHNICAL FIELD

This invention relates to apparatus for forming molds to be used in investment casting procedures, and more specifically to an apparatus for applying particulate material to a mold core used in precision casting.

BACKGROUND ART

Prior art of possible relevance includes the following U.S. Pat. Nos.: 2,932,864 issued Apr. 19, 1960 to Mellen et al; 3,713,475 issued Jan. 30, 1973 to Roelofs et al; and 3,788,380 issued Jan. 29, 1974 to Jasson et al.

Conventional methods of applying a dry particulate material to a precision mold core for forming an investment casting mold include the use of "rainfall" sanders, a fluidized bed, a rotating drum, and manual application. The previously identified Jasson et al and Roelofs et al patents exemplify typical fluidized bed application methods. The rotating drum method is illustrated in the above identified Mellen et al patent. In rainfall sanders, the particulate material is introduced above the mold core and permitted to fall, like raindrops, under the influence of gravity to impinge upon the mold core.

As is well known, the molds are built up in a step by step process on a core which may be formed of a relatively fragile material such as wax. Frequently, ten or more coatings will be required.

Because the density of particulate material is typically much greater in a fluidized bed than in other methods, the application of particulate material can be accomplished more rapidly in such a bed than by other methods. However, in most cases, for the first few coats, fluidized bed application cannot be utilized due to the particulate material scrubbing, and thus deforming, the core. Difficulty may also be encountered in fluidized bed processing of long, narrow mold cores. Such cores are relatively weak and may break in fluidized bed processing if not supported by some buildup of particulate material thereon by prior coatings. When such occurs, the broken part remains in the fluidized bed and, of course, will be subject to the dynamic forces present therein. Because its mass will typically be much greater than that of a typical particle, when the broken part strikes a core, breakage will occur with the consequence that an ever increasing number of broken parts will remain in the bed causing an ever increasing rate of breakage.

These difficulties of fluidized bed processing can be overcome through the use of rainfall sanders or rotary drum applicators. However, application by such means is quite slow and time consuming and therefore more costly.

And irrespective of the type of application employed, various difficulties are attendant their use. In rainfall sanders and rotary drum applicators, the underside of the mold core cannot be coated without rotating or otherwise manipulating and changing the position of the mold core within the unit. In the case of fluidized beds, the upper surface of the core cannot easily be coated without such rotation or manipulation.

Consequently, uneven application of the particulate material may occur or the processor must utilize expensive manipulating equipment to rotate or otherwise shift the position of the core within the processing apparatus.

And because such movement of the core is necessary, residence time of a core within the processor must necessarily be increased, thereby slowing down the process and contributing to its expense.

DISCLOSURE OF THE INVENTION

The present invention is directed to overcoming one or more of the problems as set forth above.

According to the present invention, there is provided an investment casting mold forming apparatus including a housing having an access opening through which mold cores may be introduced or removed, a diffuser within the housing, a means for directing air under pressure to the underside of the diffuser so that particulate material, when in the housing above the diffuser, will form a fluidized bed, and a means for introducing particulate material into the housing at a position spaced from the fluidized bed and for directing particulate material toward the fluidized bed.

As a consequence of this construction, initial coating of a mold core may be accomplished solely through use of the means that direct particulate material towards the fluidized bed and without using the fluidized bed to avoid scrubbing of the mold core and/or breakage thereof. Once a sufficient number of coatings have been applied to the core so as to make fluidized bed processing possible, further coatings may be added by the combined action of the fluidized bed and the particulate material directing means by locating the core between the two. This, in turn, minimizes any requirement for manipulation or movement of the core to insure even coating while permitting the high speed use of fluidized bed coating procedures. At the same time, the invention minimizes floor space requirements by providing the capability of fluidized bed coating and other coating in a single structure.

Other objects and advantages will become apparent from the following specification taken in connection with the accompanying drawings.

BEST MODE FOR CARRYING OUT THE INVENTION

Figure 2:
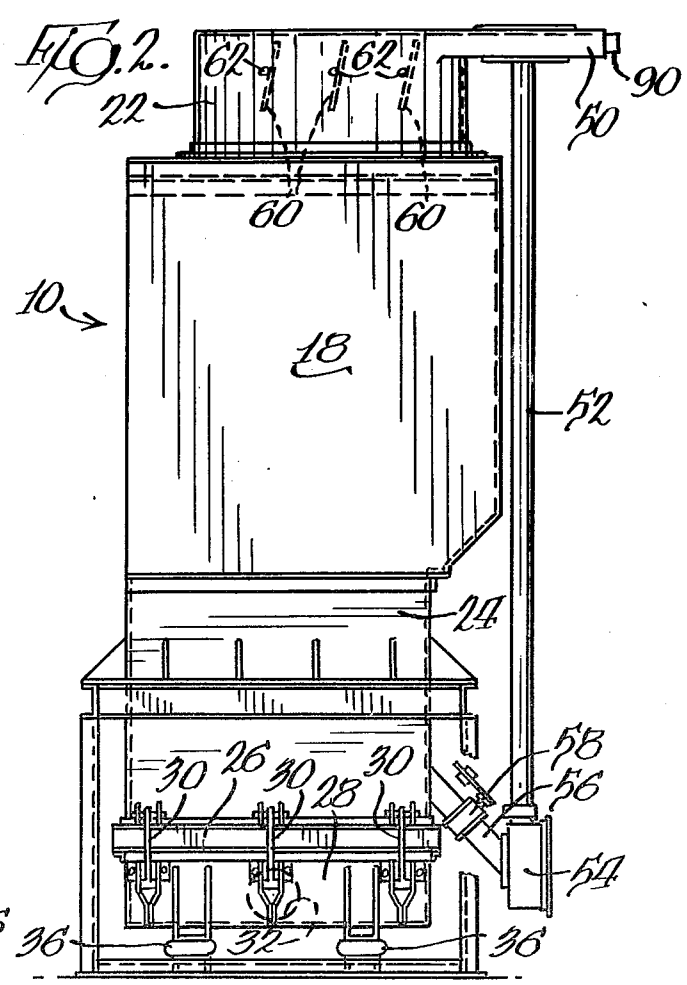
FIG. 2 is a side elevation of the apparatus.
Figure 1:
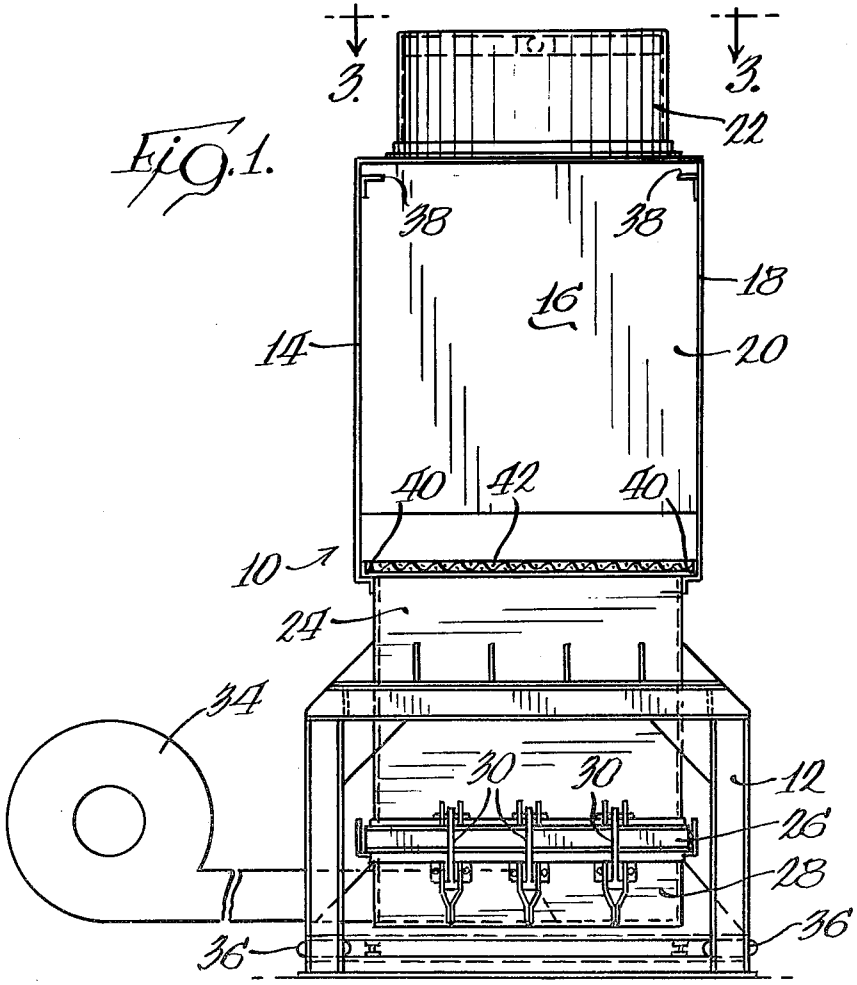
FIG. 1 is a front elevation of an investment casting mold forming apparatus made according to the invention.

An exemplary embodiment of an investment casting mold forming apparatus made according to the invention is illustrated in the drawings and with reference to FIGS. 1 and 2 is seen to include a vertically elongated housing, generally designated 10, mounted on a base 12. The mid-part of the housing 10 is rectangular in cross section and is defined by three suitably interconnected plates 14, 16, 18. The side of the housing 10 opposite the plate 16, which is the rear plate, is left open so as to define an access opening 20 through which mold cores may be disposed within the housing 10 or removed therefrom by any suitable mechanical means.

The top of the housing 10 is defined by a downwardly opening, cylindrical cap 22 which in turn is secured by any suitable means to the upper edges of the plates 14, 16 and 18.

Immediately below the plates 14, 16, 18, the housing 10 includes a box shaped section 24 which is open both top and bottom and which, as will be seen, contains a fluidized bed. The lower end of the box section 24 is closed by a conventional diffuser plate 26 or membrane. The bottom of the housing 10 is defined by a removable, rectangular, upwardly opening cap 28. A plurality of releasable latching devices 30 are disposed about the periphery of the bottom of the housing 10 and include overcenter linkages for securing the bottom 28 to the box section 24 in such a way as to sandwich, in sealing relation, the membrane 26. As seen in FIG. 2, one side of the bottom 28 includes a pressure fluid inlet 32 which in turn is connected to the output of a conventional centrifugal fan 34 (FIG. 1). Thus, the bottom 28 of the housing 10 defines a plenum for receipt of a fluid under pressure, usually air, such that the same may be directed upwardly through the diffuser or membrane 26. When such occurs, and when the particulate material used in forming a mold is disposed within the housing 10, a conventional fluidized bed will exist within the box section 24.

The membrane 24 is removable for cleaning purposes simply by releasing the latches 30 and lowering the bottom 28 to the point that the membrane 26 can be removed from between the box section 24 and the bottom 28. To assist in raising and lowering the bottom 28 during removal or installation of the membrane 26, a plurality of inflatable bladders 36 of conventional construction are disposed where illustrated between the base 12 and the underside of the bottom 28. To raise the bottom 28, the bladders 36 may be pressurized. When the bottom 28 is to be lowered, air from the interior of the bladders 26 may be released as through conventional valve stems.

Near the upper edge of the access opening 20, a pair of elongated rails 38 extend along the side plates 14 and 18. Similar rails 40 are located along the plates 14 and 18 near the lower extremity of the access opening 20 and defined by channels connecting the plates to the box section 24. A screen 42 may be removably disposed on either set of rails 38 and 40 by removal and installation from and through the access opening 20. The purpose of the screen 42 in either location, will be described in greater detail hereinafter.

Figures 3, 4:
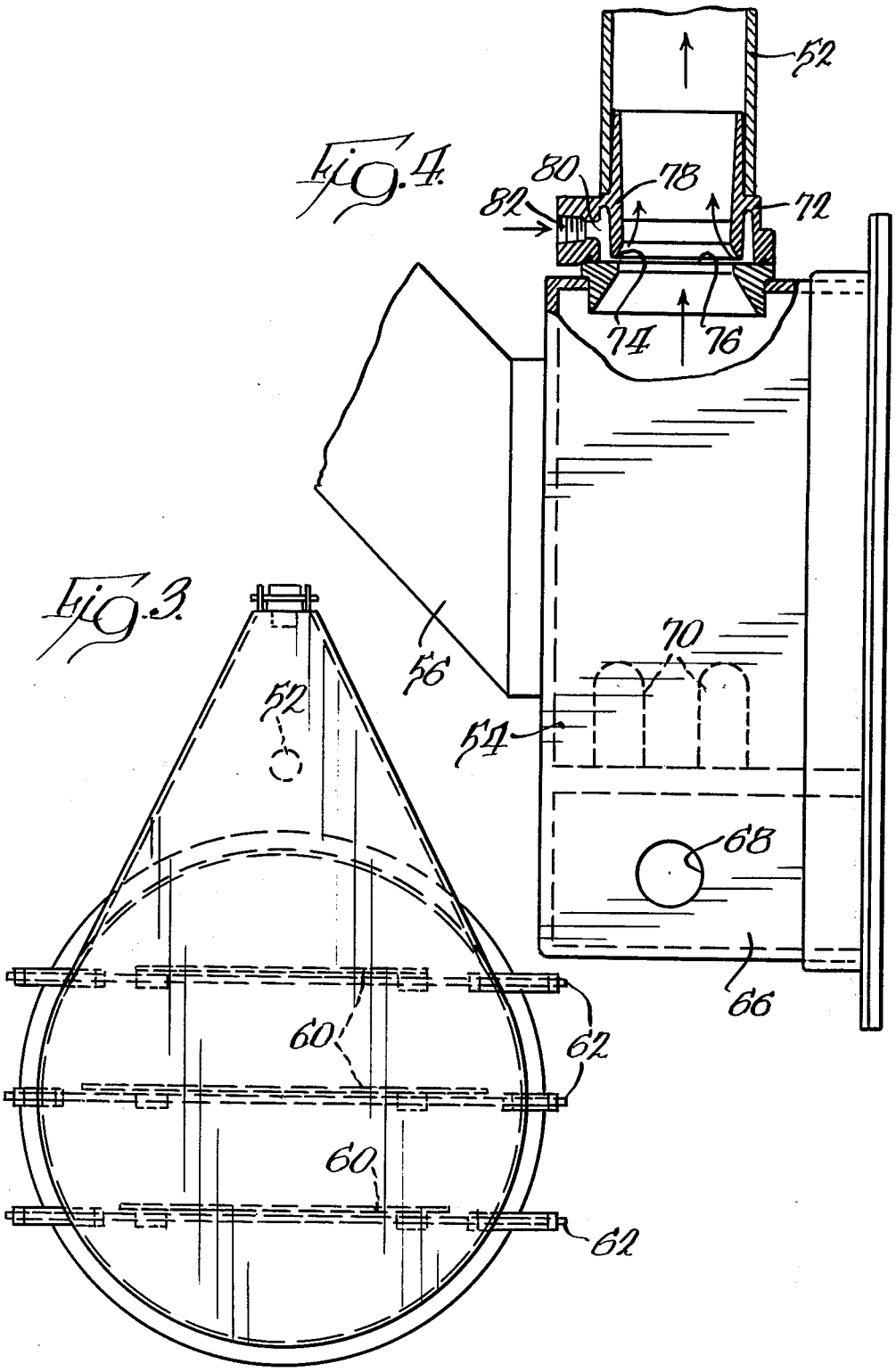
FIG. 3 is a vertical section taken approximately along the line 3—3 in FIG. 1.
FIG. 4 is an enlarged, fragmentary view, of part of a recirculating conveying system with parts shown in section for clarity.

As best seen in FIGS. 2 and 3, a pyramid shaped duct 50 extends rearwardly from the cap 22 adjacent the upper surface of the same and is in fluid communication with the interior thereof. A vertically extending conduit 52 opens to the interior of the duct 50 at its bottom and extends downwardly to a housing 54 located at about the level of the membrane 26 as best seen in FIG. 2. A diagonally extending conduit 56 is in fluid communication with the interior of the housing 54 as well as the interior of the housing 10. The conduit 56 opens to the interior of the housing 10 just above the membrane 26 and well below the upper surface of the particulate material forming a fluidized bed in the box section 24 when the apparatus is in operation. A shutoff valve 58 is located in the conduit 56 and is operable to cut off the flow of material through the conduit 56 when desired.

A series of baffles 60 are mounted at spaced locations within the cap 22 and extend thereacross. The same are rotatably mounted on rods 62 which are journalled in the cap 22 and extend from the sides thereof as best seen in FIG. 3. Suitable means are provided on the exposed ends of the rods 62 for rotating the same, and thereby rotating the corresponding baffle 60. In addition, suitable means may be provided for locking the rods 62, and thus the baffles 60, in any desired position of rotation.

Turning to FIG. 4, the lower end of the housing 54, includes a plenum 66 having an inlet 68 through which fluid under pressure, usually air, can be introduced into the plenum 66. The upper end of the plenum 66 is provided with diffusers 70 which, for economy sake, may be in the form of sound mufflers, typically employed in exhausts for pneumatic tool systems or the like.

The conduit 56 enters the housing 54 above the plenum 66 and thus, when the valve 58 is opened, particulate material from the fluidized bed contained within the housing 10 may drop under the influence of gravity into the interior of the housing 54. A small fluidized bed is established within the housing 54 when air under pressure is directed into the inlet 68.

The conduit 52 extends to the upper end of the housing 54 and is connected thereto by means of a conventional transvector 72. The transvector 72 includes a narrow ring nozzle 74 defined by an upstanding lip 76 and a sleeve 78. An annulus 80 exists on the radially outer side of the sleeve 78 and air under pressure may be directed to the annulus 80 via an inlet 82. Air entering the inlet 82 is throttled to atmospheric pressure as it passes through the ring nozzle 74 and in so doing, attains sonic velocity. The lip 76 causes the air to deflect along the radially inner surface of the sleeve 78. The inlet stream of air strikes still air adjacent the nozzle 74 and imparts movement thereto with great amplification, creating a small vacuum in the process. As a consequence, particulate material in the fluidized bed within the housing 54 is drawn upwardly into the transvector 72 and impelled therefrom through the conduit 54 into the duct 50 (FIGS. 2 and 3). The apex of the pyramid shaped duct 50 is provided with a similar transvector 90 (FIG. 2) which then causes the particulate material and the air stream to be redirected generally horizontally towards the interior of the cap 22. The baffles 60 are set so as to substantially evenly distribute the particulate material entering the cap 22 to fall under the influence of gravity about the interior of the housing 10.

Thus, there is provided a distributor for distributing the particulate material in a rainfall type pattern. In normal operation, the screen 42 will be on the rails 38 which will further serve to distribute the particulate material and which will retain any large clumps of material, including broken parts.

When it is desired to clean the particulate material, the screen 42 may be disposed on the rails 40 and the particulate circulated in the path just mentioned, proper sized particles descending into the box section 24 through the screen 42 and oversized as well as clumps being retained on the screen 42 for easy removal through the access opening 20.

INDUSTRIAL APPLICABILITY

In a typical method of operation, a bare mold core, formed of wax or the like, will be introduced into the housing 10 through the access opening 20. The coating material, in particulate form, contained within the box section 24 is permitted to descend therefrom into the housing 54 at a rate controlled by the setting of the valve 58. From the housing 54, it is conveyed to the distributor provided by the cap 22 to fall on the mold core in a manner similar to that found in the typical rainfall sander. If desired, the fluidized bed in the box section 24 may be generated at this time, but it is not necessary to do so. If the bed is in operation, the mold core introduced into the housing 10 should not be lowered into the bed or else undesirable scrubbing or breaking may occur.

Coatings are built up on the core in the usual fashion by successive introductions into the housing 10 and when the composite structure is sufficiently strong as to withstand the forces encountered in the fluidized bed, it may be set in operation or, if already in operation, the partially coated molds lowered into it within the box section 24. At this time, typically, particulate material will continue to be distributed through the housing 10 from the cap 22 to insure that the uppermost surface of the core is coated without requiring undue manipulation of the core within the fluidized bed.

In some instances, at this stage in the operation, distribution of particulate material from the cap 22 may be terminated and coating achieved solely through the use of a fluidized bed.

From the foregoing, it will be appreciated that an apparatus for use in forming molds for use in investment casting and made according to the invention provides several advantages over the prior art. For example, a single handling apparatus can be used to introduce molds into the housing 10 to be treated by both rainfall and fluidized bed application. This is in contrast to prior art procedures wherein two such handling devices would be required, one for a rainfall or rotary applicator, and one for a fluidized bed.

Similarly, the required space necessary for the apparatus in terms of floor space occupied is minimized since two differing operations can be performed at a single station as opposed to two separate stations requiring considerably more space in the prior art. Additionally, manipulation requirements during coating may be minimized through simultaneous application through both fluidized bed and rainfall application of particulate material.

The apparatus is easily adapted for cleaning and removal of undesirable material by disposing the screen 42 on the rails 40 and is self-cleaning during normal operation when the screen 42 is disposed on the rails 38. And, of course, capital investment is reduced as one apparatus can perform the functions of two heretofore required.

I claim:

1. Investment casting mold forming apparatus comprising:

a vertically extending housing (10) having a top (22) and a bottom (28) and an access opening (20) intermediate the top and bottom;

a diffuser (26) within said housing below said opening and above said bottom;

means (32) for introducing a fluid under pressure into said housing between said bottom and said diffuser whereby a fluidized bed of particulate material may be established within said housing above said diffuser; and means (50,52,60) for introducing particulate material into said housing at an elevated position therein above said access opening such that the particulate material may descent within said housing after being introduced thereto;

the interior of said housing in the vicinity of said fluidized bed and said access opening being unobstructed so that a mold core may be introduced into said housing through said access opening and be coated with particulate material from said particulate material introducing means as it descends therefrom toward said fluidized bed or by immersion in said fluidized bed.

2. Apparatus for use in forming molds for investment casting comprising:

a housing (10) having an access opening (20);

a diffuser (26) in said housing;

means (32) for directing air under pressure to the underside of said diffuser so that particulate material, when in said housing above said diffuser, will form a fluidized bed;

means (50,60) within said housing and spaced from said fluidized bed for directing particulate material past said access opening and toward said fluidized bed; and means (52,54,56) for withdrawing particulate material from said fluidized bed and providing it to said particulate material directing means to provide for circulation of the particulate material;

the interior of said housing in the vicinity of said fluidized bed and said access opening being unobstructed during mold forming so that a mold core may be introduced into said housing through said access opening and be coated with particulate material from said particulate material directing means as it is directed therefrom past said access opening and towards said fluidized bed or by immersion in said fluidized bed.

3. The apparatus of claim 2 including a screen within said housing and within the path of circulation of said particulate material, means for locating said screen adjacent said particulate material directing means to assist in distributing particulate material about the interior of said housing, said housing being provided with means for locating said screen between said access opening and said fluidized bed for cleaning the particulate material as it passes said access opening and moves towards said fluidized bed.

4. The apparatus of claim 3 wherein said screen is removable from said housing through said access opening.

5. The apparatus of claim 3 wherein said withdrawing means comprises an air conveyor (52,72,74,76,78,80,90).

6. Investment casting mold forming apparatus comprising:

a vertically extending housing (10) having a top (22), a bottom (28), and an intermediate access opening (20); a diffuser (26) within said housing below said access opening, said bottom defining a plenum below said diffuser;

a fluid entrance (32) in said housing in fluid communication with said plenum for receipt of a pressurized fluid that may pass upwardly through said diffuser to generate a fluidized bed of particulate material above the diffuser when particulate material is within said housing;

a particulate material distributor (50,60) at said housing top having a particulate material entrance for distributing particulate material about the housing such that the particulate material may descend by gravity to said fluidized bed, a particulate material exit (56) just above said diffuser and within the fluidized bed through which particulate material may exit the fluidized bed; and a conveyor (52,54) interconnecting said exit and said particulate material entrance for conveying particulate material received from said exit to said distributor to establish a particulate material circulation path;

the interior of said housing in the vicinity of said fluidized bed and said access opening being unobstructed so that a mold core may be introduced into said housing through said access opening and be coated with particulate material from said distributor as it descends therefrom towards said fluidized bed or by immersion in said fluidized bed.

* * * * *